US005410895A

United States Patent [19]

Hsu et al.

[11] Patent Number: 5,410,895

[45] Date of Patent: May 2, 1995

[54] U-SHAPED LOCK

[76] Inventors: Chung-Hung Hsu, No. 158, Kung Yuan North Road; Yung-Ta Lin, No. 67, Lane 77, Sec. 1, An Ho Road, both of Tainan, Taiwan, Prov. of China

[21] Appl. No.: 171,686

[22] Filed: Dec. 22, 1993

[51] Int. Cl.[6] ..... E05B 67/24

[52] U.S. Cl. ..... 70/39; 70/28; 70/43

[58] Field of Search ..... 70/28, 39, 38 B, 38 C, 70/41–43

[56] References Cited

U.S. PATENT DOCUMENTS

| | | | |
|---|---|---|---|
| 956,007 | 4/1910 | Weeks | 70/43 |
| 1,621,347 | 3/1927 | Biemer | 70/38 C |
| 1,979,186 | 10/1934 | Biemer | 70/38 C |
| 2,255,402 | 9/1941 | Vile | 70/380 |
| 4,545,224 | 10/1985 | Zane | 70/39 |
| 4,841,753 | 6/1989 | Patton | 70/38 A X |
| 4,918,949 | 4/1990 | Newbold | 70/39 X |
| 5,194,845 | 3/1993 | Sirmon et al. | 70/39 X |
| 5,253,496 | 10/1993 | Wang | 70/38 R |

FOREIGN PATENT DOCUMENTS

| | | | |
|---|---|---|---|
| 388160 | 1/1924 | Germany | 70/38 C |
| 491840 | 2/1930 | Germany | 70/38 C |
| 525898 | 3/1932 | Germany | 70/38 C |
| 473317 | 7/1952 | Italy | 70/38 C |

*Primary Examiner*—Lloyd A. Gall

*Attorney, Agent, or Firm*—Morton J. Rosenberg; David I. Klein

[57] ABSTRACT

A U-shaped lock is provided which includes a straight tubular housing, a locking unit disposed within the housing, and a U-shaped shackle. The U-shaped shackle has one end provided with a bend stopper to fit in a shackle hole of the housing and the other end provided with a notch for receiving a flat rectangular portion of a dead bolt to lockingly engage or disengage the shackle. The locking unit includes a cylindrical member combined and rotating together with a lock cylinder. The lock cylinder has a key hole for insertion of a key for rotating the lock cylinder and a projecting block extending from a rear end of the lock cylinder and engaged in a hole of the cylindrical member. The dead bolt is moved forward or backward responsive to rotation of the key in the lock cylinder to cause the flat rectangular portion of the dead bolt to engage or disengage from the notch of the shackle.

1 Claim, 5 Drawing Sheets

U-SHAPED LOCK

BACKGROUND OF THE INVENTION

A common U-shaped lock, shown in FIG. 6, includes a U-shaped shackle 1 with an annular groove 11 formed in each of the shackle's ends. Each of the grooves 11 is locked by a dead bolt of a locking unit disposed in a housing 2. The locking principle of the locking unit of this conventional lock is shown in FIG. 7, wherein a key is inserted in a lock block 3 to rotate the block 3 and an actuating block 31. The actuating block 31 pushes a right and a left pusher 321,331 of a right and a left slide block 32, 33, forcing two dead bolts 322,332 to move inward and thereby free the U-shaped shackle 1 from the housing 2. Then in locking it, the two ends of the U-shaped shackle i are moved into the housing 2, and the key is pulled out of the locking block 3. Removal of the key allow the springs 34, 35 to push the right and left slide block 32, 33 to the respective right and left sides, forcing the dead bolts 322,332 to engage the two grooves 11 of the shackle 1. In this position, the shackle 1 is locked. If this lock is needed to be unlocked, the key is again used to rotate the locking block 3 for unlocking.

Nevertheless, this conventional lock has undesirable disadvantages as follows:

1. Though the U-shaped shackle is easy to make, the housing is made by a molding process, by means of molds of rather high cost.

2. The structure of the locking unit is rather complicated, inconvenient for assemblage, which results in a high cost.

3. Two springs are used for locking, but they are subject to a loss of elasticity by incessant compression in locking, and in addition, incorrect assemblage of the springs can cause a malfunction of the lock.

SUMMARY OF THE INVENTION

The present invention has been devised to offer a kind of U-shaped lock, improved so as to overcome the above-mentioned disadvantages.

A U-shaped shackle in this invention has only one end which is locked or unlocked by a locking unit contained in a housing made of a tube, thereby simplifying its use and assembly. The locking unit has a cylindrical block which carries a lock cylinder, and a cylindrical member combined with the lock cylinder. The lock cylinder and cylindrical member rotate together to move a dead bolt forward to lock the shackle or backward to unlock the shackle with a key. Such operation is without the use of springs, for ensuring correct locking and unlocking movement and without failure caused by fatigue or rust of components.

BRIEF DESCRIPTION OF THE DRAWINGS

The invention will be better understood by reference to the accompanying drawings, wherein.

DESCRIPTION OF THE PREFERRED EMBODIMENTS

Figure 1:
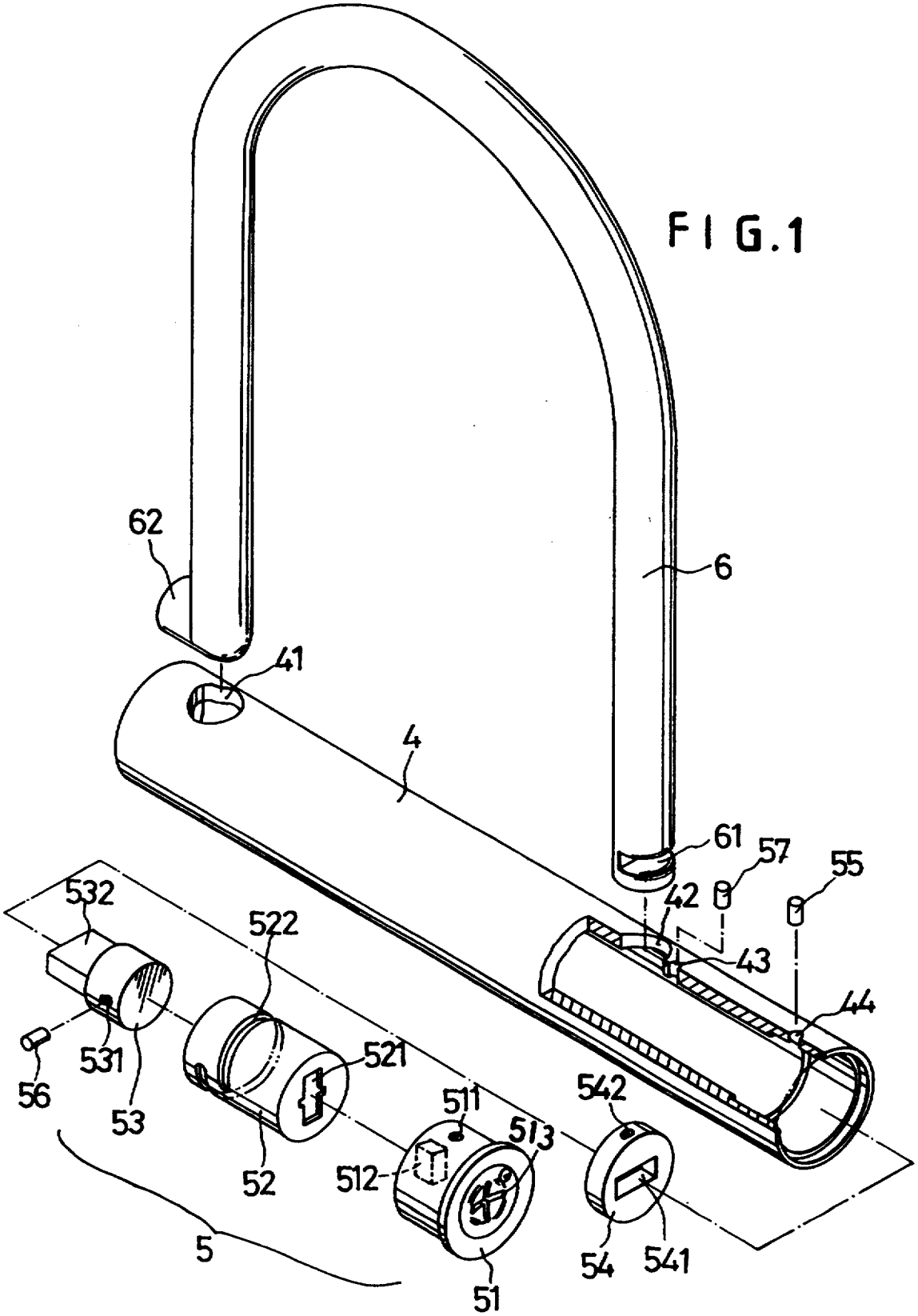
FIG. 1 is an exploded perspective view of a U-shaped lock in the present invention.

A U-shaped lock in the present invention, as shown in FIG. 1, includes a housing 4, a locking unit 5, and a U-shaped shackle 6 combined together.

The housing 4 is made of a steel tube, having formed therein two shackle holes 41, 42 spaced apart for respective receipt of the two ends of the shackle 6, and two pin holes 43, 44 for respective receipt of the pins 57, 55.

The locking unit 5 includes a cylindrical block 51, a cylindrical member 52, a dead bolt 53 and a locating member 54 combined together and disposed within the housing 4. The cylindrical block 51 has a pin hole 511 formed in an outer circumferential surface for a pin 55 to fix the block 51 with the housing 4. A lock cylinder is rotatively displaced within block 51 when the proper key is inserted therein. Lock cylinder 513 includes an actuating block 512 disposed on a front end surface thereof to fit in a hole 521 formed in a rear side surface of the cylindrical member 52. The cylindrical member 52 has a helical guide groove 522 formed around an intermediate portion thereof and a longitudinally directed hole for receipt of the dead bolt 53 therein from an inner side. The dead bolt 53 has a cylindrical portion and a flat rectangular portion 532. A pin hole 531 is formed in the outer surface of the cylindrical portion for receipt of a pin 56 which is inserted through the helical guide groove 522 of cylindrical member 52 and the pin hole 531 to combine the dead bolt 53 with the cylindrical member 52. The flat rectangular portion 532 of dead bolt 53 fits into a slot 541 of the locating member 54. Locating member 54 has a pin hole 542 formed in a circumferential surface for receipt of a pin 57 to fit therein to fix firmly the locating member 54 with the housing 4.

The U-shaped shackle 6 has a notch 61 formed in a first end thereof, and a bent portion formed on the opposing second end to define a stopper 62. The stopper 62 prevents easy withdrawal of the second end of shackle 6 from a hole 41 of the housing 4, through which it passes.

Figure 2:
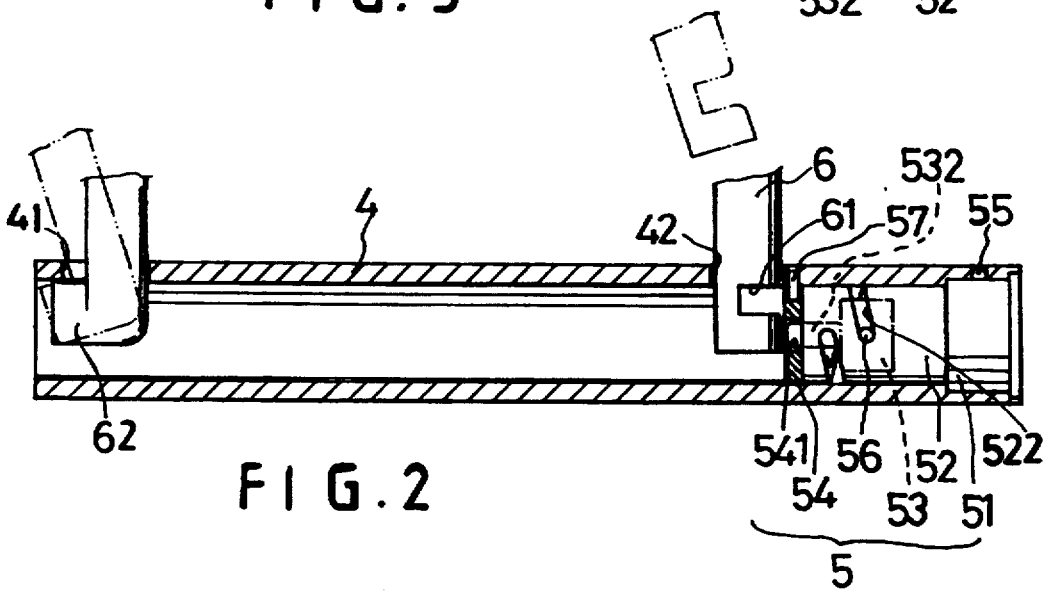
FIG. 2 is a cross-sectional view of the U-shaped lock in the present invention.

In assembling the lock, as shown in FIG. 2, first, the locating member 54, the dead bolt 53, the cylindrical member 52 and the cylindrical block 51 are deposited, in order, within the housing 4. Those elements are disposed with the flat rectangular portion 532 of the dead bolt 53 engaging the slot 541 of the locating member 54, and with the actuating block 512 engaging the hole 521 of the cylindrical member 52. The dead bolt 53 is combined with the cylindrical member 52 with the pin 56 before the dead bolt 53 and the cylindrical member 52 are placed in the housing 4. Subsequently, the pins 57 and 55 are inserted into the respective holes 43,542 and 44, 511, to finish the assembly of the locking unit 5 with the housing 4.

Figure 3:
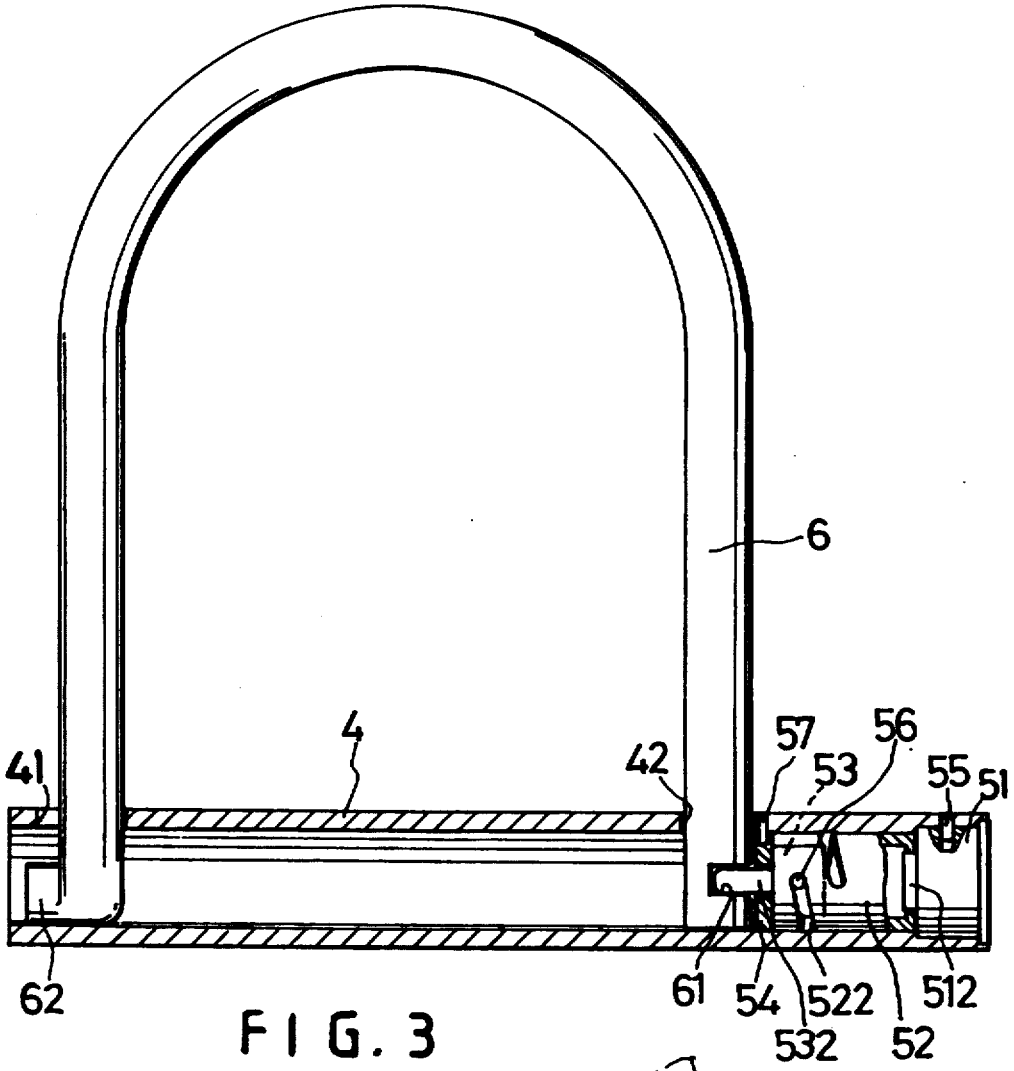
FIG. 3 is a cross-sectional view of the U-shaped lock being in locked condition in the present invention.

In using this lock, as shown in FIG. 2, the end with the stopper 62 of the U-shaped shackle 6 is slantingly inserted in the hole 41 of the housing 4, and the other end thereof is inserted in the hole 42. Then a key is inserted in the lock cylinder 513 and rotated clockwise to rotate the actuating block 512 and then the cylindrical member 52 therewith. The rotation of the cylindrical member 52 moves the dead bolt 53 forward, by means of the combination of the pin 56 with the helical groove 522 of the cylindrical member. Such displacement of dead bolt 53 forces an outer end of the flat rectangular portion 532 of the dead bolt 53 to engage the notch 61 of the shackle 6, for locking the shackle 6 and thereby making it substantially immovable, as shown in FIG. 3.

Figure 4:
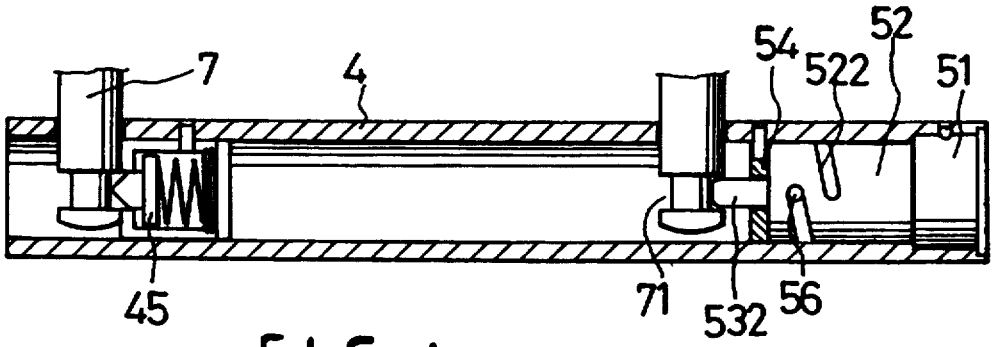
FIG. 4 is a cross-sectional view of a second embodiment of the U-shaped lock in the present invention.
Figure 7:
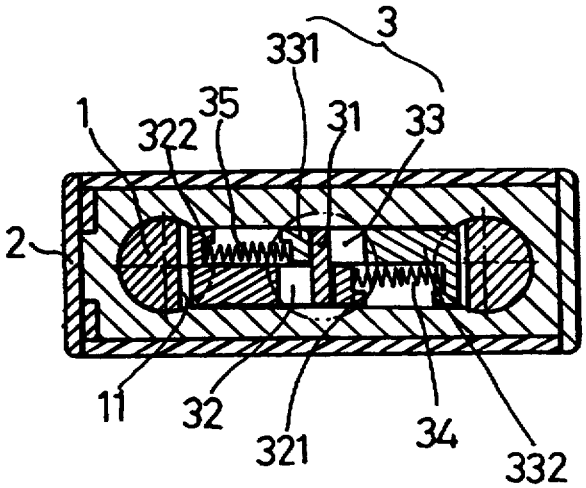
FIG. 7 (PRIOR ART)
FIG. 7 is a cross-sectional view of the conventional U-shaped lock.

A second embodiment of the U-shaped lock of the present invention, as shown in FIG. 4, includes a U-shaped shackle 7 having two ends respectively provided with an annular groove 71 instead of a notch 61 and a bent stopper 62. An elastic stop block 45 is used to secure the end of the shackle 7 not engaged by the dead bolt 53.

Figure 5:
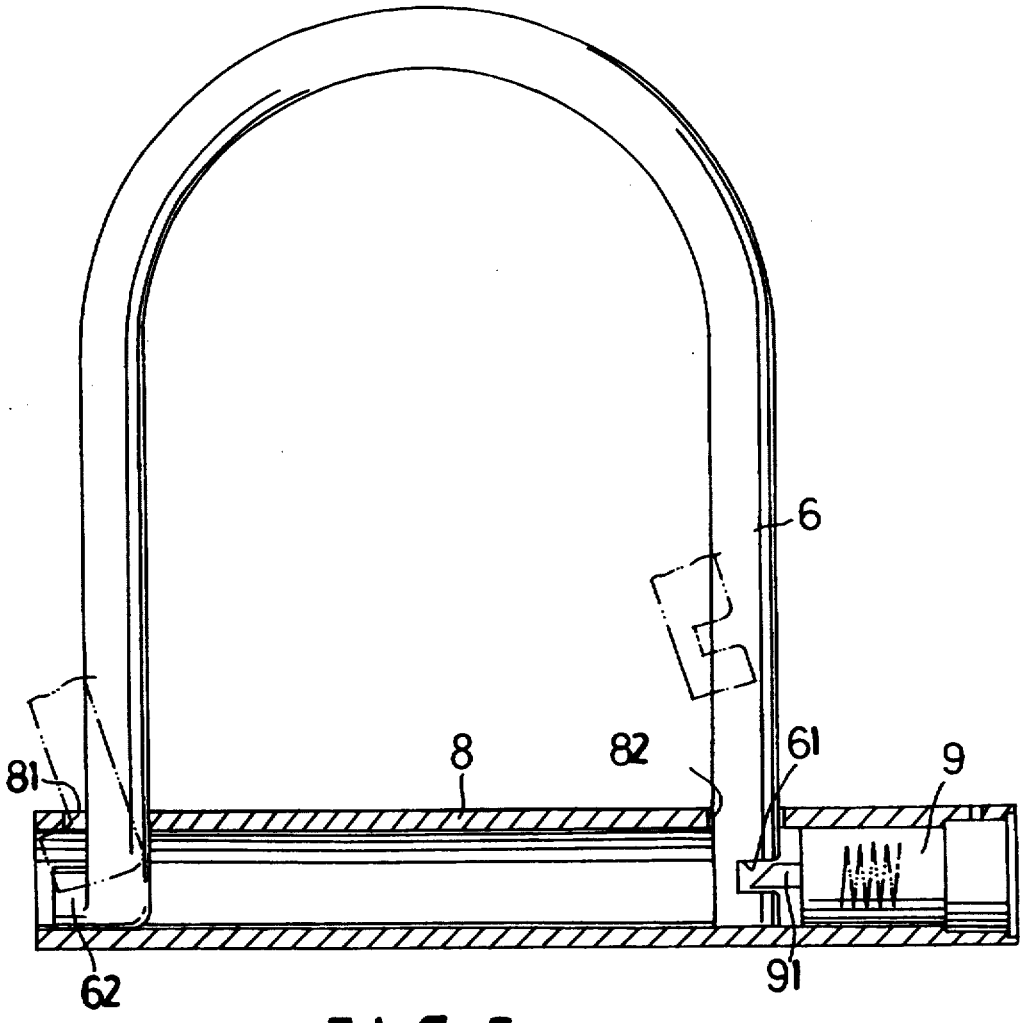
FIG. 5 is a cross-sectional view of a third embodiment of the U-shaped lock in the present invention.
Figure 6:
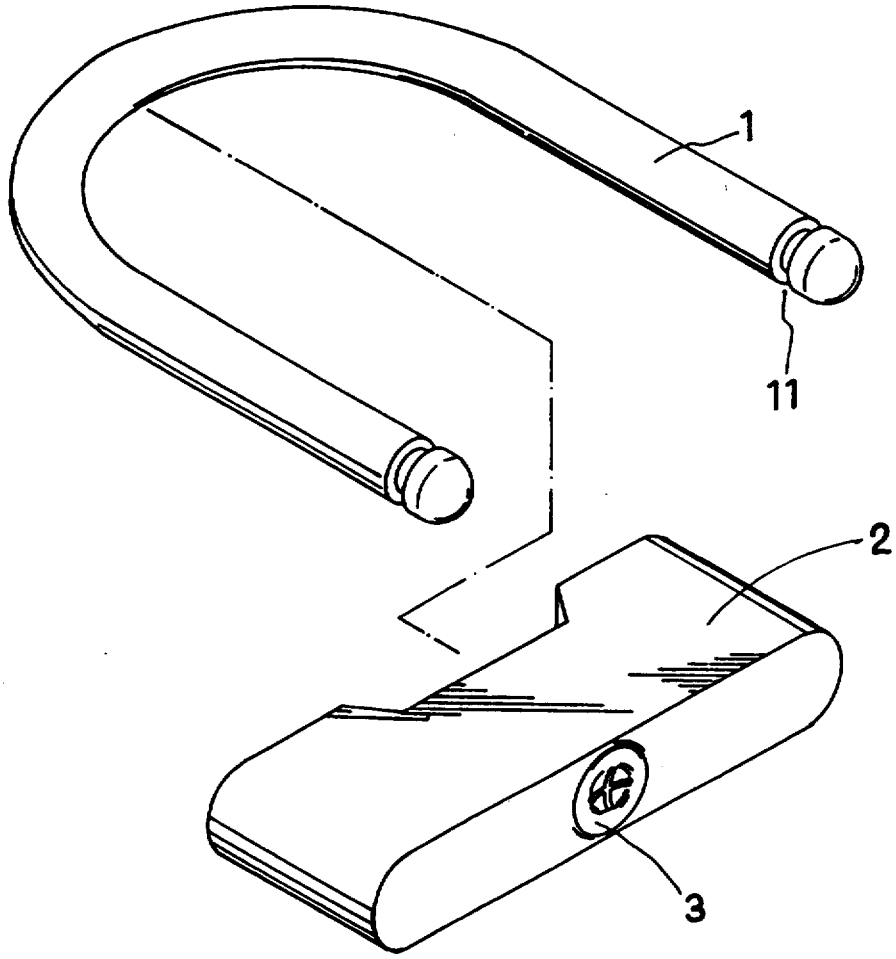
FIG. 6 (PRIOR ART)
FIG. 6 is a perspective view of the conventional U-shaped lock.

In the embodiment of FIG. 5, the housing 8 is formed with a pair of spaced openings 81 and 82 for respective receipt of opposing ends of the shackle 6. The locking unit 9 includes a dead bolt having an engagement portion 91 provided with an inclined surface to engage the notch 61 of shackle 6.

While the preferred embodiments of the invention have been described above, it will be recognized and understood that various modifications may be made therein and the appended claims are intended to cover all such modifications which may fall within the spirit and scope of the invention.

What is claimed is:

1. A U-shaped lock comprising:

a housing defined by a tubular steel tube having two shackle holes formed in longitudinally spaced relation for receipt of opposing first and second ends of a shackle and two pin holes formed therein for receipt of a respective pair of first pins for coupling said housing with a locking unit;

said locking unit being disposed within said housing and comprising:

(a) a cylindrical block having a pin hole formed in an outer circumferential surface for receipt of a portion of one of said pair of first pins extending through a first of said two housing pin holes for coupling said cylindrical block with said housing, said cylindrical block including a lock cylinder rotatively coupled thereto, said lock cylinder having an actuating block projecting from a rear end surface thereof for engagement with a rectangular hole of a cylindrical member to rotate both said lock cylinder and said cylindrical member together responsive to rotation of a key disposed within a key hole of said lock cylinder;

(b) said cylindrical member having said rectangular hole formed in a front end surface, and having a helical guide groove formed through a cylindrical surface of said cylindrical member for receipt of a second pin to guide displacement of a dead bolt responsive to rotation of said cylindrical member;

(c) said dead bolt having a longitudinally extended cylindrical portion and a flat rectangular portion extending longitudinally from said cylindrical portion, said cylindrical portion having a pin hole formed therein for receipt of a portion of said second pin extending through said groove of said cylindrical member to displaceably combine said dead bolt with said cylindrical member, Whereby rotation of said cylindrical member longitudinally displaces said dead bolt;

(d) a locating member having a cylindrical shape to fit in said housing for maintaining said cylindrical member and said dead bolt in place, said locating member having a pin hole formed therein for receipt of a portion of the other of said pair of first pins extending through a second of said two housing pin holes, said locating member having a slot formed therein for passing said flat rectangular portion of said dead bolt therethrough; and, (e) a U-shaped shackle having a first end passing through a first of said two shackle holes, said first end of said shackle being provided with a notch formed therein for receipt of said flat rectangular portion of said dead bolt to engage said U-shaped shackle with said housing in locking relationship, said shackle having an opposing second end provided with a bent stopper to fit firmly in a second of said two shackle holes of said housing and substantially prevent displacement therefrom when said notch of said U-shaped shackle is engaged by said dead bolt.

* * * * *